United States Patent [19]

Moen

[11] 4,265,377

[45] * May 5, 1981

[54] MULTIPLE NOZZLE FLUID DISPENSER HAVING UNIFORM OPENINGS IN AN OPERATING BAR

[76] Inventor: Lenard E. Moen, 7914 Michigan, Whittier, Calif. 90602

[ * ] Notice: The portion of the term of this patent subsequent to Jun. 5, 1996, has been disclaimed.

[21] Appl. No.: 3,081

[22] Filed: Jan. 12, 1979

Related U.S. Application Data

[63] Continuation-in-part of Ser. No. 846,899, Oct. 31, 1979, Pat. No. 4,157,149.

[51] Int. Cl.[3] ..... B67D 3/00

[52] U.S. Cl. ..... 222/486; 68/205 R; 118/411; 137/883; 137/885; 222/330; 239/67; 239/562

[58] Field of Search ..... 222/330, 331, 481, 482, 222/484, 485, 486; 118/313, 315, 316, 411, 412; 239/67, 551, 562, 563; 137/637, 883, 885; 68/200, 203, 205 R; 8/149

[56] References Cited

U.S. PATENT DOCUMENTS

| | | | |
|---|---|---|---|
| 2,749,005 | 6/1956 | Plusquellic | 222/485 X |
| 2,791,353 | 5/1957 | Dorn et al. | 222/485 X |
| 2,804,764 | 9/1957 | Runton | 68/205 R X |
| 3,286,689 | 11/1966 | Ziemba | 222/486 X |
| 3,420,208 | 1/1969 | Guthrie | 118/411 X |
| 3,991,917 | 11/1976 | Moen | 222/486 |
| 4,157,149 | 6/1979 | Moen | 222/486 |

*Primary Examiner*—Robert J. Spar
*Assistant Examiner*—Fred A. Silverberg
*Attorney, Agent, or Firm*—Frederick E. Mueller

[57] ABSTRACT

A multiple nozzle fluid dispenser having jointly and independently actuable valves that are interchangeable as to their relative positions and having means for accommodating a valve operating mechanism for the valves to any arrangement of the valves.

6 Claims, 3 Drawing Figures

MULTIPLE NOZZLE FLUID DISPENSER HAVING UNIFORM OPENINGS IN AN OPERATING BAR

RELATED APPLICATIONS

This is a continuation-in-part of application Ser. No. 846,899 filed Oct. 31, 1979, now U.S. Pat. No. 4,157,149.

Reference is made herein to my co-pending application Ser. No. 846,900, filed on Oct. 31, 1977, entitled Making of Containers with Tri-Laminated End Walls.

BACKGROUND OF THE INVENTION

1. Field of the Invention

This invention relates generally to fluid handling apparatus. More particularly, the invention relates to a multiple nozzle fluid dispenser, such as a glue gun, and a multiple nozzle valve assembly for the dispenser.

2. Prior Art

As will be evident from the ensuing description, the features of this invention may be embodied in a variety of fluid handling devices which require control of fluid flow in a number of separate fluid passages. The primary application of the invention, however, is in a multiple nozzle fluid dispenser for dispensing fluids in preselected complex fluid delivery patterns. For this reason, the invention will be described in connection with a multiple nozzle glue dispenser, or glue gun as it is commonly called, for applying a complex pattern of glue stripes or beads to a workpiece. This workpiece may be a preformed cardboard container body blank which may be folded or erected to a container configuration.

The prior art is replete with a vast assortment of multiple nozzle glue dispensers or glue guns. Examples of such glue dispensers are found in U.S. Pat. Nos. 3,420,208; 3,126,574; 3,286,689; 3,190,259; 3,348,520; 3,509,849; and 3,088,433. Another example of a multiple nozzle glue dispenser is found in my prior U.S. Pat. No. 3,991,917.

SUMMARY OF THE INVENTION

This valve assembly has a plurality of valves which are actuable jointly by common operating means for controlling fluid flow through corresponding nozzles of the assembly. The valve assembly includes at least one additional valve actuable independently of the jointly actuable valves for controlling fluid flow through a corresponding nozzle or nozzles of the valve assembly. The jointly actuable and independently actuable valves are interchangeable, without alteration or modification of the common operating means for the jointly actuable valves, such that the valve assembly may embody any number of each of these valve types and any arrangement of the valves.

The jointly actuable valve structure of this dispenser or glue gun is essentially identical to that described in my prior U.S. Pat. No. 3,991,917. In this patented glue gun, the individual, jointly actuable valves have flexible valve stems which are deflected laterally by the common valve operating means to open and close the valves in common.

The individual adjustability of the jointly actuable valves of the fluid dispenser to selectively prevent, inhibit, or regulate their opening and closing movement by the common valve operating means, the independent actuability of the independently actuable valves, and the interchangeability of the latter valves and the jointly actuable valves, cooperate to provide a fluid dispenser capable of dispensing fluid in a wide variety of dispensing patterns. The glue dispenser of the invention, for example, is ideally suited for use in the container forming machine of my earlier mentioned co-pending application, Ser. No. 846,900.

DESCRIPTION OF THE PREFERRED EMBODIMENTS

Figures 1, 2, 3:
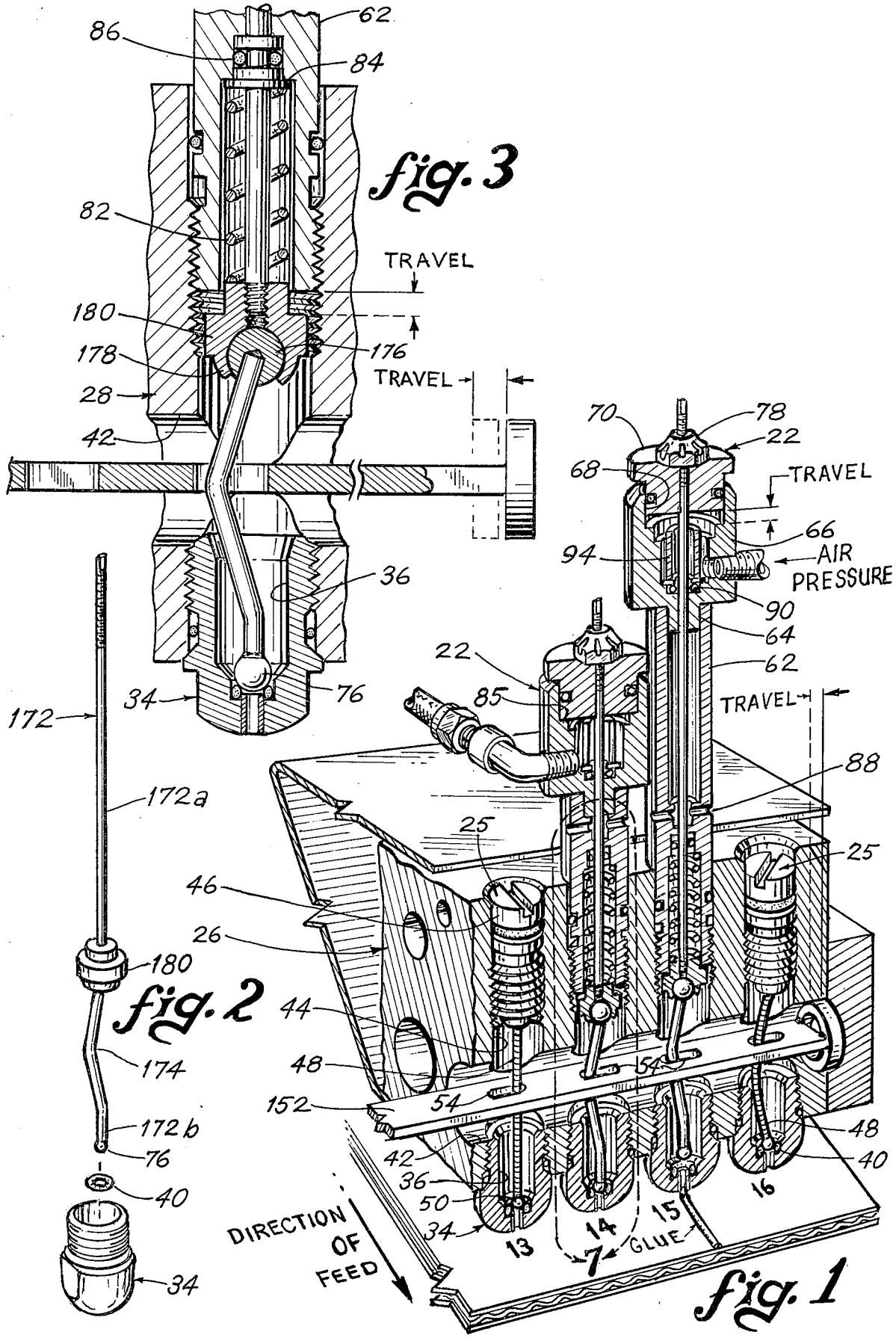
FIG. 1 is a fragmentary perspective view showing a presently preferred embodiment of the invention.
FIG. 2 is an exploded perspective view of components of one of the independently actuable valves of FIG. 1.
FIG. 3 is an enlarged axial section outlined as the area 3 of FIG. 1.

The basic glue gun structure is identical in all essential respects to that described in my prior U.S. Pat. No. 3,991,917 and, accordingly, need not be described in elaborate detail. This basic glue gun structure comprises an elongate bar-like body 26 (FIG. 1). This body functions, in part, as a common valve body for a multiple valve assembly 28, comprising the jointly actuable valves 25, and the independently operable individual valves 22.

The jointly actuable valves 25 are operable between open and closed states by common valve operating means for controlling glue flow from the glue line 16 to corresponding glue dispensing nozzles 34 spaced along the lower side of the body 26. Each dispenser nozzle 34 has a generally cup-like shape and is threaded in the underside of the body 26. Extending axially through each nozzle is a passage 36, reduced at one end to form a dispensing orifice 38 opening through the outer or lower end of the nozzle. Surrounding the inner end of this orifice is an O-ring 40 forming a valve seat about the orifice. Nozzle passages 36 open to a bore 42 extending longitudinally through the body 26, and providing a manifold communicating the glue line 16 to the nozzle passages. Entering the upper side of the body 26 on the axis of each nozzle 34 is a threaded bore 44. Each bore 44 opens to the longitudinal body bore or glue manifold 42, diametrically opposite the corresponding dispenser nozzle 34.

Each jointly actuable valve 25 is contained within and comprises a stem holder 46 threaded in one of the body bores 44. Secured at its upper end to each stem holder 46 by a ball and socket connection (not shown) is a laterally flexible valve stem 48. The lower end of each valve stem has a valve element or ball 50 engagable with the corresponding nozzle valve seat 40. The several valve stems 48 traverse the body bore or manifold 42.

The common valve operating means comprises a valve operator or operator bar 152 extending axially through the body bore 42. Spaced along this bar are slots 54 through which extend the valve stems 48.

The operator bar slots 54 are longitudinally dimensioned to release the flexible valve stems 48 for engagement of their valve elements 50 with the corresponding valve seats 40 to close the glue valves 25 when the operator bar 152 occupies its normal retracted position of FIG. 1. When extended to the left in FIG. 1 by air pressure upon opening of a control valve, the valve operator bar 152 deflects the valve stems 48 laterally to open the glue valves 25, as more fully explained in my U.S. Pat. No. 3,991,917. As also explained in this patent, the valve stem holders 46 are adjustable axially in their respective body bores 44 to selectively prevent, inhibit or regulate opening and closing movement of each valve 25 by the operator bar.

As explained below, the independently actuable and jointly actuable valves 22, 25 are interchangeable. That is to say, any jointly actuable valve 25 may be replaced by and independently actuable valve 22. As explained below, in the embodiment of my U.S. Pat. No. 4,157,149 the common valve operating bar 152 must be conditioned to accommodate this interchange of the independently and jointly actuable valves.

Referring particularly to FIG. 1, each independently actuable glue valve 22 comprises a tubular barrel 62 threaded at its lower end in a dispenser body bore 44. Snugly fitted in the upper end of the barrel 62 is a coaxial boss 64 on the lower end of a cylinder 66. A stepped bore 68 extends coaxially into the upper end of this cylinder.

Slidable in the upper, large diameter end of the cylinder bore 68 is a piston 70. A valve rod 172 extends centrally through the piston 70, the cylinder 66, and the barrel 62.

On the upper end of the valve rod 172 is threaded a nut 78 forming a thrust shoulder engaging the top of the piston 70. Threaded on the lower end of the rod is a nut 180 forming a spring seat on the rod. A spring 82 acting between the spring seat 180 and a washer on a shoulder 84 in the valve barrel 62 urges the valve rod 172 downwardly against a shoulder 85 in its cylinder bore 68 which limits downward travel of the piston. The valve element 76 engages its valve seat 40 to close the corresponding nozzle 34.

The upper end of the valve rod 172 slides in the lower end of the valve cylinder bore 68. A seal ring 90 seals the rod to the cylinder 66. Above the seal ring 90 is a washer 92 which seats downwardly on a shoulder in the cylinder. A sleeve 94 surrounds the valve rod 72 above the washer 92. The cylinder bore 68 of each independently actuable valve 22 is connected to an air hose.

FIGS. 1–3 illustrate an improved, presently preferred embodiment of the invention which eliminates the need for specially adapting the slots of the operator bar 152 to different glue patterns. Except as noted below, the improved embodiment is identical to the first described embodiment of my U.S. Pat. No. 4,157,149, which is hereby incorporated by this reference, and, accordingly, need not be described in detail except with respect to the particular differences to be noted.

Referring to FIGS. 1–3, a different form of valve rod assembly is employed for each of the independently actuable glue valves 22, thus permitting all of the longitudinally extending slots of the operator bar to be identical, at least in length. Stated otherwise, the same operator bar can be employed without change for any desired combination of independent valves 22 and jointly actuable valves 25.

More particularly, each independently actuable valve 22 has a valve rod 172 whose upper portion **172*a* is threadedly interconnected at its lower end to a nut 180 which replaces the fluted nut of the first embodiment. In lieu of the flutes of the fluted nut, the nut 180 is of an outer diameter to define a clearance with respect to the surrounding wall of the corresponding bore 44** to define a glue bypass.

The lower portion of the rod assembly 172 comprises a solid or rigid bent link or rod member **172*b* whose intermediate portion is formed with an offset or joggle 174. The bent link 172*b* is preferably made of a stainless steel rod material and at its upper end is fixedly fitted with a steel ball 176 around which the lips of a socket 178 formed in the lower face of the nut 180 is swivelly seated. The lower end of the bent link or rod 172*b* is provided, as before, with a valve element or ball 76 for engagement with the corresponding nozzle valve seat 40**.

The valve operator bar 152 of the improved embodiment is formed with longitudinally extending slots of a uniform length for operative co-action with the valve stems **172*b* of the jointly actuable valves 25 only. For example, the slots of the operator 152 may take the size and shape of the slots 54 of the valve operator bar of the first embodiment. It will now be seen that with the just described construction of the valve rod 172, upon each actuation of the operator bar 152 to move the operator bar to the left, as indicated by the travel or stroke range shown in FIG. 3, none of the slots 54 in the area of the bar corresponding to the independently actuable valves 22 can come into engagement with the corresponding bent links 172*b* by virtue of the joggle or offset dimension 174 of the links. It should also be noted that by virtue of the swivel connection of the upper ends of the bent links 172*b* that each of the bent links is, in effect, self-aligning with respect to the corresponding slots 54** of the operator bar.

It is to be understood that the invention is not limited in its application to the details of construction and the arrangement of the components set forth in the foregoing description are illustrated in the drawings. The invention is capable of other embodiments and of being practiced and carried out in various ways. Also, it should be understood that the phraseology and terminology employed herein is for the purposes of description and should not be regarded as limiting.

What is claimed as new in support of Letters Patent is:

1. In a multiple valve assembly having:

a body including a plurality of valves with a corresponding plurality of valve seats;

a first one of said valves including a laterally flexible valve stem having a valve element at one end movable into and from engagement with a corresponding valve seat by lateral deflection of said valve stem to open and close the corresponding valve;

a second, independently actuable one of said valves including a valve rod having a valve element at one end movable into and from seating engagement with a corresponding valve seat by axial movement of said valve rod to open and close the corresponding valve;

a valve actuator for said independently actuable valve secured to the opposite end of said valve rod to move the latter axially;

said body containing a bore traversed by said valve stem and said valve rod; and operating means for said first valve movable in said body bore for exerting lateral deflecting forces of said flexible valve stem only;

the improvement wherein:

said valve operating means comprises an operating bar movable longitudinally in said body bore through a given stroke and having clearance openings through which said valve stem and valve rod extend, and means for accommodating said operating bar openings to said stem and to said rod such that the bar exerts lateral deflecting forces on said flexible valve stem only during movement of the bar through said given stroke, said accommodating means comprising uniform bar openings and cooperating shape characteristics of said valve rod.

2. The valve assembly improvement of claim 1 wherein:

each said valve rod has an offset median portion and a swivel connection to the valve actuator.

3. The valve assembly improvement of claim 1 wherein:

there is a plurality of said first valves jointly actuable by said operating means, said jointly actuable valve includes a valve stem holder located opposite the corresponding valve seat and secured to the opposite end of the corresponding valve stem, and means whereby said jointly actuable valve may be replaced by an independently actuable valve and said independently actuable valve may be replaced by a jointly operable valve.

4. In a multiple nozzle fluid dispenser having:

a body including a multiplicity of fluid dispensing nozzles, a fluid inlet communicating with said nozzles, and a plurality of valves with a corresponding plurality of valve seats for controlling fluid flow to said nozzles;

said valves including a plurality of jointly actuable valves each having a laterally flexible valve stem having a valve element at one end movable into and from engagement with a corresponding valve seat by lateral deflection of said valve stem to open and close the corresponding valve;

said plurality of valves including at least one independently actuable valve including a valve rod having a valve element at one end movable into and from seating engagement with a corresponding valve seat by axial movement of said valve rod to open and close the corresponding valve;

a valve actuator for said independently actuable valve secured to the opposite end of the valve rod to move the latter axially;

said body containing a bore traversed by said valve stem and said valve rod; and an operating means for said jointly actuable valves movable in said body bore for exerting lateral deflecting forces on said flexible valve stems only;

the improvement wherein:

said valve operating means comprises an operating bar movable longitudinally in said body bore through a given stroke and having clearance openings through which said valve stems and valve rods extend, and means for accommodating said operating bar openings to said stems and to said rods such that the bar exerts lateral deflecting forces only on said flexible valve stems only during movement of the bar through said given stroke, said accommodating means comprising uniform bar openings and cooperating shape characteristics of said valve rods.

5. The fluid dispenser improvement of claim 4 wherein:

each said valve rod has an offset median portion and a swivel connection to the valve actuator.

6. The fluid dispenser improvement of claim 4 wherein:

said jointly actuable valve includes a stem holder in said body opposite said valve seat and secured to the opposite end of said valve stem, and said valve stem holder and valve actuator is releasably secured to and accessible externally of said body in a manner such that said stem holder and said flexible valve stem may be replaced by a valve actuator and valve rod, and said valve actuator and said valve rod may be replaced by a stem holder and valve stem, whereby the arrangement of said jointly and independently actuable valves may be varied.

* * * * *